US011619241B2

(12) United States Patent
Servies et al.

(10) Patent No.: US 11,619,241 B2
(45) Date of Patent: Apr. 4, 2023

(54) VENTILATION FAN INSTALLATION SYSTEM

(71) Applicant: Home Depot Product Authority, LLC, Atlanta, GA (US)

(72) Inventors: Nicholas Servies, Kennesaw, GA (US); Jonathan Spoerke, Smyrna, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 84 days.

(21) Appl. No.: 17/371,808

(22) Filed: Jul. 9, 2021

(65) Prior Publication Data

US 2023/0012260 A1 Jan. 12, 2023

(51) Int. Cl.

| | |
|---|---|
| ***F04D 29/60*** | (2006.01) |
| ***F04D 29/62*** | (2006.01) |
| ***F24F 13/32*** | (2006.01) |

(52) U.S. Cl.

CPC ..... *F04D 29/601* (2013.01); *F04D 29/626* (2013.01); *F24F 13/32* (2013.01)

(58) Field of Classification Search

CPC ..... F04D 29/601; F04D 29/626; F24F 13/32
See application file for complete search history.

(56) References Cited

U.S. PATENT DOCUMENTS

| | | | | |
|---|---|---|---|---|
| 2,800,849 A | | 7/1957 | Spear | |
| 2,891,754 A | * | 6/1959 | Kuhlenschmidt ..... | F24F 13/32 62/262 |
| 4,188,656 A | | 2/1980 | Howard | |
| 4,250,540 A | | 2/1981 | Kristofek | |
| 4,336,749 A | | 6/1982 | Barnhart et al. | |
| 4,673,149 A | | 6/1987 | Grote et al. | |
| 4,766,806 A | | 8/1988 | Tomiser, Jr. et al. | |
| 4,834,615 A | | 5/1989 | Mauch et al. | |
| 4,867,640 A | | 9/1989 | Penlesky et al. | |

(Continued)

FOREIGN PATENT DOCUMENTS

| | | |
|---|---|---|
| CA | 1053635 | 5/1979 |
| CA | 1138848 | 1/1983 |

(Continued)

OTHER PUBLICATIONS

ISA/US, ISR/WO issued in Appl. No. PCT/US22/36383, dated Oct. 5, 2022, 12 pgs.

*Primary Examiner* — Anita M King
(74) *Attorney, Agent, or Firm* — Greenberg Traurig, LLP

(57) ABSTRACT

An assembly includes a first bracket and a second bracket. The first bracket includes a first member that includes a plurality of fingers and a first channel between the plurality of fingers. The first channel includes a plurality of teeth. A first flange extends from the first member and includes a first engagement surface. The second bracket includes a second member and a third member spaced from the second member. A second channel is formed between the second member and the third member. A second flange extends from the second member on an opposite side of the second member from the third member. The second flange includes a second engagement surface. In an installed configuration, the first bracket is secured to the second bracket; the first engagement surface faces the second engagement surface; and the plurality of fingers are inserted into the second channel.

20 Claims, 10 Drawing Sheets

(56) References Cited

U.S. PATENT DOCUMENTS

| | | | | |
|---|---|---|---|---|
| 5,314,148 | A | 5/1994 | Jones | |
| 5,351,929 | A * | 10/1994 | Vallance | F16B 12/2027 248/222.51 |
| 5,609,414 | A | 3/1997 | Caluori | |
| 5,725,302 | A | 3/1998 | Sirkin | |
| 5,879,232 | A | 3/1999 | Luter, II et al. | |
| 5,931,432 | A | 8/1999 | Herold et al. | |
| 5,941,625 | A | 8/1999 | Morand | |
| 5,996,184 | A | 12/1999 | Mah et al. | |
| 6,000,818 | A | 12/1999 | Caluori | |
| 6,585,486 | B2 | 7/2003 | Birdsell et al. | |
| 6,896,394 | B2 | 5/2005 | Houle | |
| 7,530,717 | B2 | 5/2009 | Magisano et al. | |
| 7,549,780 | B2 | 6/2009 | Caluori | |
| 7,618,167 | B2 | 11/2009 | Bedard | |
| 7,673,842 | B2 | 3/2010 | Nevers et al. | |
| 7,854,537 | B2 | 12/2010 | Caluori | |
| 7,874,708 | B1 | 1/2011 | Jones et al. | |
| 8,308,322 | B2 | 11/2012 | Santiago et al. | |
| 8,475,014 | B2 | 7/2013 | Jones et al. | |
| 9,151,456 | B2 | 10/2015 | Bitton et al. | |
| 9,239,153 | B2 | 1/2016 | Goodman et al. | |
| 9,416,989 | B1 | 8/2016 | Lawrence | |
| 9,816,717 | B1 | 11/2017 | Lawrence | |
| 10,359,212 | B2 * | 7/2019 | Darby | F24F 1/027 |
| 2005/0058554 | A1 * | 3/2005 | Fahrenbach | F04D 19/042 417/313 |
| 2008/0261508 | A1 | 10/2008 | Deng | |
| 2008/0318515 | A1 | 12/2008 | Yeung | |
| 2009/0010007 | A1 | 1/2009 | Caluori | |
| 2013/0130612 | A1 | 5/2013 | Penlesky et al. | |
| 2016/0230770 | A1 | 8/2016 | Dent et al. | |
| 2016/0268958 | A1 | 9/2016 | Wildes et al. | |
| 2016/0305635 | A1 | 10/2016 | Stathes et al. | |
| 2017/0227196 | A1 | 8/2017 | Hildebrand | |
| 2017/0307134 | A1 | 10/2017 | Padrin | |
| 2018/0023581 | A1 | 1/2018 | Karst et al. | |
| 2020/0085215 | A1 | 3/2020 | Ng et al. | |

FOREIGN PATENT DOCUMENTS

| | | |
|---|---|---|
| CA | 1295508 | 2/1992 |
| CA | 1332592 | 10/1994 |
| CA | 2161051 | 4/1997 |
| CA | 2184149 | 1/1999 |
| CA | 2551740 | 1/2007 |
| CA | 2602045 | 3/2008 |
| CA | 2594897 | 1/2011 |
| CA | 2618210 | 6/2011 |
| CA | 2738006 | 7/2012 |
| CA | 2762259 | 5/2013 |
| CA | 2898489 | 8/2013 |
| CA | 2577753 | 9/2014 |
| CA | 2796557 | 5/2015 |
| CA | 2852102 | 1/2018 |

* cited by examiner

VENTILATION FAN INSTALLATION SYSTEM

FIELD

This disclosure relates generally to support systems for hanging apparatuses. More particularly, this disclosure relates to ventilation fan hanger brackets and installation systems such as, but not limited to, bathroom ventilation fan hanger brackets and installation systems.

BACKGROUND

Ventilation fans such as bathroom ventilation fans are generally installed in a ceiling. Typically, the ventilation fans are recessed into the ceiling. Installation of the ventilation fans can be difficult as the ventilation fans are installed overhead.

SUMMARY

In some embodiments, an assembly includes a first bracket. In some embodiments, the first bracket includes a first member. In some embodiments, the first member includes a plurality of fingers and a first channel between the plurality of fingers. In some embodiments, the first channel includes a plurality of teeth. In some embodiments, a first flange extends from the first member and includes a first engagement surface. In some embodiments, the assembly includes a second bracket. In some embodiments, the second bracket includes a second member. In some embodiments, a third member is spaced from the second member. In some embodiments, a second channel is formed between the second member and the third member. In some embodiments, a second flange extends from the second member on an opposite side of the second member from the third member. In some embodiments, the second flange includes a second engagement surface. In some embodiments, in an installed configuration, the first bracket is secured to the second bracket; the first engagement surface faces the second engagement surface; and the plurality of fingers are inserted into the second channel.

In some embodiments, the first bracket and the second bracket are different colors.

In some embodiments, at least one of the first bracket or the second bracket are made of plastic.

In some embodiments, the first member and the first flange are made of a single piece, unitary construction.

In some embodiments, the second member and the second flange are made of a single piece, unitary construction.

In some embodiments, the second channel includes a lock. In some embodiments, in the installed configuration, the plurality of teeth engage the lock.

In some embodiments, the plurality of teeth are symmetrical and disposed on opposite sides of the first channel.

In some embodiments, a ventilation fan assembly includes a housing. In some embodiments, the housing includes a plurality of apertures. In some embodiments, an installation assembly includes a first bracket. In some embodiments, the first bracket includes a first member. In some embodiments, the first member includes a plurality of fingers and a first channel between the plurality of fingers. In some embodiments, the first channel includes a plurality of teeth. In some embodiments, a first flange extends from the first member and includes a first engagement surface. In some embodiments, the installation assembly includes a second bracket. In some embodiments, the second bracket includes a second member. In some embodiments, a third member is spaced from the second member. In some embodiments, a second channel is formed between the second member and the third member. In some embodiments, a second flange extends from the second member on an opposite side of the second member from the third member. In some embodiments, the second flange includes a second engagement surface. In some embodiments, in an installed configuration, the second bracket is inserted through a first of the plurality of apertures; the first bracket is secured to the second bracket; the first engagement surface faces the second engagement surface; and the plurality of fingers are inserted into the second channel.

In some embodiments, the second bracket is secured to the housing in the installed configuration.

In some embodiments, the first bracket is slidably engaged with the second bracket in the installed configuration.

In some embodiments, the second bracket is secured to the housing by a snap-fit connection.

In some embodiments, the ventilation fan assembly includes a plurality of installation assemblies. In some embodiments, the plurality of installation assemblies includes four installation assemblies.

In some embodiments, the ventilation fan assembly includes a fan cover.

In some embodiments, the first member and the first flange are made of a single piece, unitary construction.

In some embodiments, the second member and the second flange are made of a single piece, unitary construction.

In some embodiments, the second channel includes a lock, and wherein in the installed configuration, the plurality of teeth engage the lock.

In some embodiments, the plurality of teeth are symmetrical and disposed on opposite sides of the first channel.

In some embodiments, a method includes installing a first bracket into an aperture in a housing of a ventilation fan assembly. In some embodiments, the method includes resting an engagement surface of a flange of the first bracket on an upper surface of a ceiling panel. In some embodiments, the method includes inserting a second bracket into a channel of the first bracket until an engagement surface of the second bracket engages with a lower surface of the ceiling panel. In some embodiments, the lower surface is opposite the upper surface.

In some embodiments, the method includes installing a fan cover to the housing.

BRIEF DESCRIPTION OF THE DRAWINGS

References are made to the accompanying drawings that form a part of this disclosure and that illustrate embodiments in which the systems and methods described in this Specification can be practiced.

Like reference numbers represent the same or similar parts throughout.

DETAILED DESCRIPTION

Ventilation fans are generally installed in a ceiling of, for example, a bathroom or the like. An installation process for the ventilation fans can be challenging because of working overhead. Additionally, the ventilation fan is inserted through a hole in the ceiling. As a result, it is important to minimize an outer extent of the ventilation fan assembly.

Embodiments of this disclosure are directed to ventilation fan assemblies and installation assemblies for ventilation fans. The embodiments described herein include a plurality of brackets in which a first of the brackets can be secured to a housing of the ventilation fan and a second of the brackets can be securely engaged with the first of the brackets to secure the ventilation fan to the ceiling or other surface in an installed configuration. The embodiments described can advantageously reduce an amount of effort in installing a ventilation fan. Some embodiments can advantageously reduce an amount of time required to install a ventilation fan.

Figure 1:
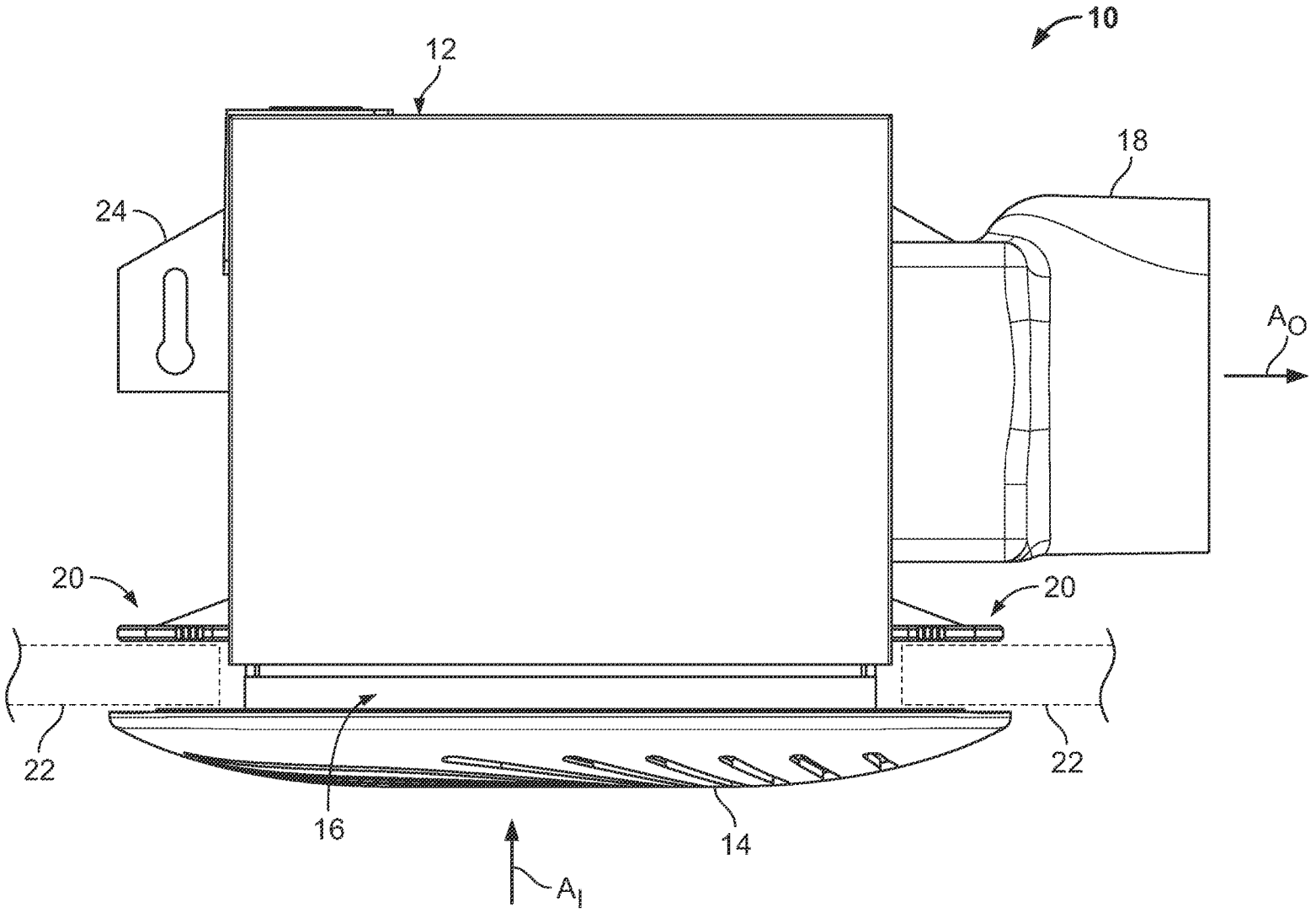
FIG. 1 is a side view of a ventilation fan assembly, according to some embodiments.

FIG. 1 is a side view of an example ventilation fan assembly 10, according to some embodiments. The ventilation fan assembly 10 can be, for example, a bathroom ventilation fan assembly configured to be installed in a bathroom. The ventilation fan assembly 10 is shown in an installed configuration in which the ventilation fan assembly 10 is securely installed into a ceiling of a room.

The ventilation fan assembly 10 includes a fan housing 12 and a fan cover 14. The fan housing 12 is generally disposed within the ceiling of the room and the fan cover 14 is disposed below the ceiling. As a result, the fan cover 14 is visible to a person within the room in which the ventilation fan assembly 10 is disposed.

The ventilation fan assembly 10 also includes a mounting plate 16 that is configured to be secured to the fan housing 12 and the fan cover 14. An airflow outlet 18 is provided from the fan housing 12 and configured to be connected to a duct (not shown) to exhaust the air drawn through the fan housing 12 from the building in which the ventilation fan assembly 10 is installed.

The example ventilation fan assembly 10 includes a plurality of installation assemblies 20. The installation assemblies 20 are configured to be secured to the fan housing 12 and a ceiling panel 22. The ceiling panel 22 can be, for example, drywall or the like. The installation assemblies 20 can also be configured to be secured to the mounting plate 16. In some embodiments, the installation assemblies 20 can be configured to engage with the fan cover 14 as well. The installation assemblies 20 are shown and described in additional detail below. In some embodiments, a single installation assembly 20 may be sufficient to secure the fan housing 12 to the ceiling panel 22 (e.g., in conjunction with other support features). In other embodiments, such as the embodiment illustrated in FIG. 1, two or more installation assemblies 20 may be desired.

In operation, the ventilation fan assembly 10 is configured to draw an inlet airflow $A_I$ through the fan cover 14 and output an outlet airflow $A_O$ from the outlet 18.

The ventilation fan assembly 10 can include one or more mounting brackets 24. For example, the mounting bracket 24 can be used to secure the ventilation fan assembly 10 to, for example, a rafter or other stud in the ceiling of the room in which the ventilation fan assembly 10 is installed.

Generally, the ventilation fan assembly 10 is installed in a location that is overhead of the installer (i.e., in a ceiling). It can be cumbersome to install traditional ventilation fans. The installation assemblies 20 are configured to reduce an amount of effort to install the ventilation fan assembly 10 and to reduce an amount of time to complete the installation of the ventilation fan assembly 10.

It is to be appreciated that the ventilation fan assembly 10 includes additional features that are unrelated to installation of the ventilation fan assembly 10, and therefore not described in detail herein. For example, the ventilation fan assembly 10 includes a blower assembly disposed within the fan housing 12.

Figure 2:
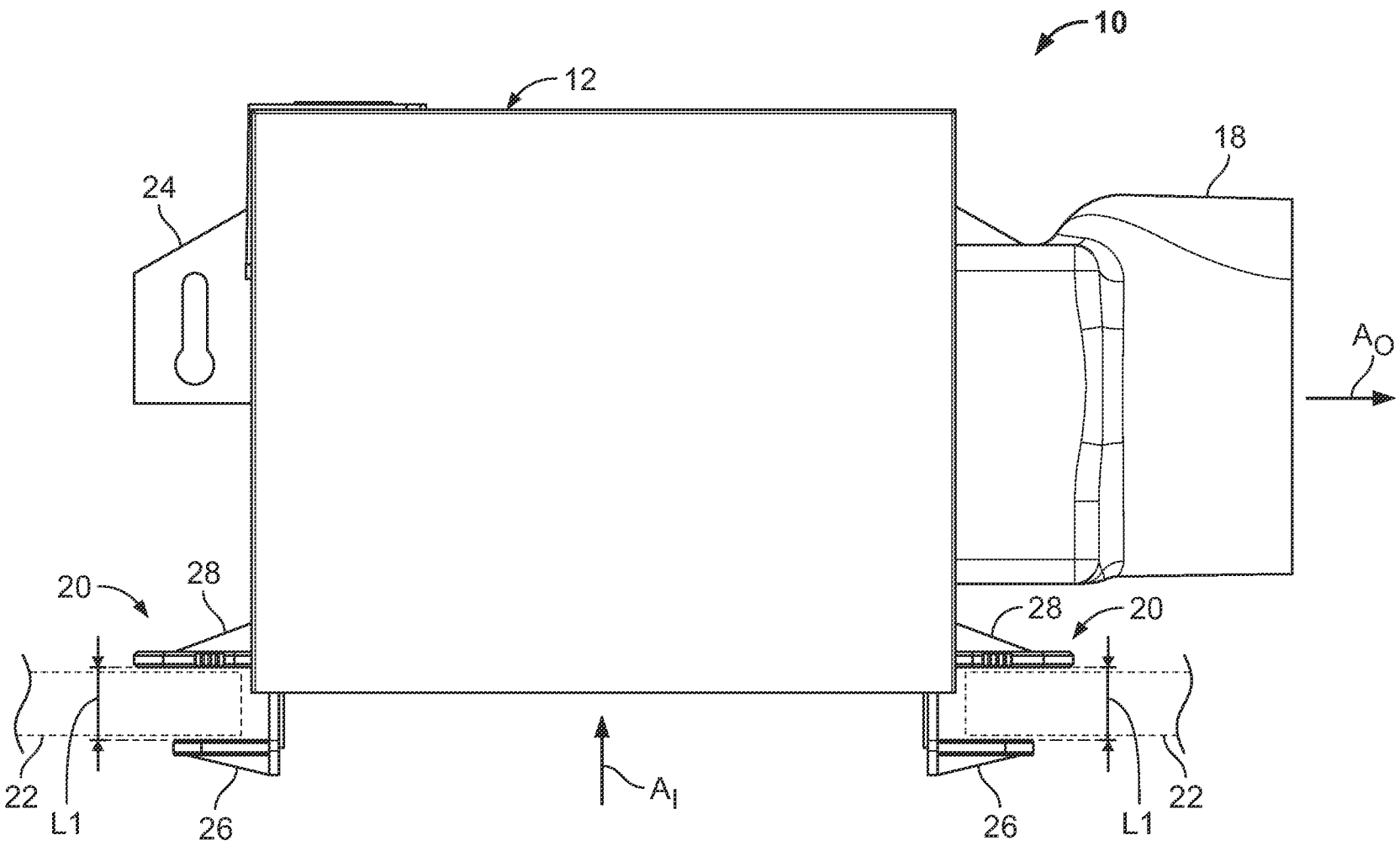
FIG. 2 shows a side view of the ventilation fan assembly of FIG. 1, according to some embodiments.

FIG. 2 shows a side view of the ventilation fan assembly 10, according to some embodiments. In the view of FIG. 2, the fan cover 14 and the mounting plate 16 of the ventilation fan assembly 10 have been removed for clarity of illustration of other components of the ventilation fan assembly 10.

As illustrated in FIG. 2, the installation assemblies 20 each include a first bracket 26 and a second bracket 28. The first bracket 26 and the second bracket 28 collectively sandwich the ceiling panel 22 therebetween and are coupled to the housing 12. As a result, the ventilation fan assembly 10 is maintained in the installed configuration.

The first bracket 26 and the second bracket 28 are separate pieces that can be removably secured to each other, in some embodiments. To enable insertion of the fan housing 12 into the ceiling, the first bracket 26 and the second bracket 28 can be removable from the fan housing 12.

In some embodiments, the second bracket 28 can be secured to the fan housing 12 when the fan housing 12 is above the ceiling. For example, In some embodiments, the second bracket 28 can be snap fit to the fan housing 12. It is to be appreciated that it is possible to attach the second bracket 28 to the fan housing 12 via mechanisms other than a snap fit connection. For example, In some embodiments, the second bracket 28 can be secured to the fan housing 12 with a mechanical fastener such as, but not limited to, a screw, a bolt, or the like. In some embodiments, the second bracket 28 can also be secured to the fan housing 12 via other methods such as, but not limited to, adhesives, adhesive tapes, or the like.

The first bracket 26 can be secured to the second bracket 28. In some embodiments, the first bracket 26 can be slidably connected to the second bracket 28. In some embodiments, the first bracket 26 can be detached from the second bracket 28 such as, for example, to uninstall the ventilation fan assembly 10. In such embodiments, the first bracket 26 can also be removed from the fan housing 12.

It is to be appreciated that there are two installation assemblies 20 visible in FIG. 2. In some embodiments, the ventilation fan assembly 10 can include four installation assemblies 20. For example, In some embodiments, the ventilation fan assembly 10 can include two installation assemblies 20 on a first side of the ventilation fan assembly 10 and two installation assemblies 20 on a second side of the ventilation fan assembly 10 (the first side being opposite the second side). It is to be appreciated that a different number of installation assemblies 20 can be used within the scope of this disclosure. For example, the number of installation assemblies 20 can be greater than four. Additionally, it is possible to have installation assemblies 20 on all four sides of the ventilation fan assembly 10.

A distance L1 between the first bracket 26 and the second bracket 28 can be varied according to an installation. For example, the ceiling panel 22 can have a different thickness depending upon the room in which the ventilation fan assembly 10 is being installed. As such, the distance L1 between the first bracket 26 and the second bracket 28 can be adjustable to account for such variations between rooms and between houses. As a result, the installation assemblies 20 may be used for different installation locations without requiring different parts.

For simplicity of parts, the first bracket 26 and the second bracket 28 for each of the installation assemblies 20 can be identical to each other, in some embodiments. That is, the first bracket 26 and the second bracket 28 can be interchangeable across various installation locations of the ventilation fan assembly 10.

In some embodiments, the first bracket 26 and the second bracket 28 can be made of the same material as each other. In some embodiments, the first bracket 26 and the 28 can be made of different materials from each other. In some embodiments, the first bracket 26 and the second bracket 28 can be made of plastic. In some embodiments, the first bracket 26 and the second bracket 28 can be color coded. As a result, for example, the first bracket 26 and the second bracket 28 can be easily identified to reduce an amount of effort in installing the ventilation fan assembly 10.

Figure 3:
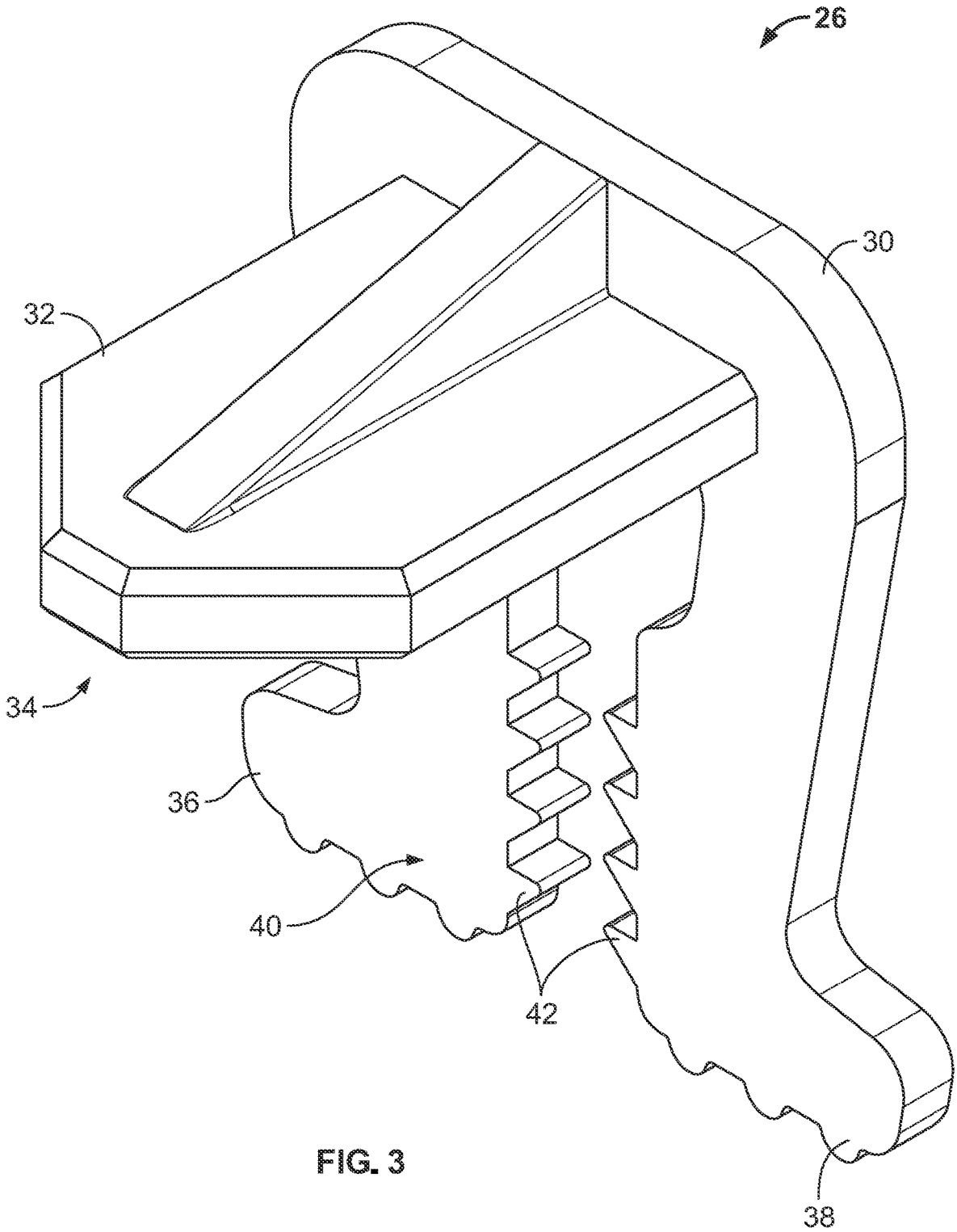
FIG. 3 shows a perspective view of the first bracket of FIG. 2, according to some embodiments.

FIG. 3 shows a perspective view of the first bracket 26 of FIG. 2, according to some embodiments.

The first bracket 26 includes a member 30 having a flange 32 extending therefrom. The member 30 and the flange 32 can be a single piece, unitary construction. As used herein, a single piece, unitary construction means that the member 30 and the flange 32 are integrally formed together, not separate pieces joined together. As such, there are no mechanical fasteners, adhesives, combinations thereof, or the like, between the member 30 and the flange 32. In some embodiments, the single piece can include multiple materials integrally formed. For example, the first bracket 26 can be injection molded, 3D printed, or the like. The flange 32 includes an engagement surface 34. The engagement surface 34 is configured to engage with the ceiling panel 22 when the ventilation fan assembly 10 is in the installed configuration. As such, the engagement surface 34 can be a planar surface.

The member 30 can include finger 36 and finger 38. The fingers 36, 38 can be configured to be flexible and resilient so that a channel 40 formed between the finger 36 and the finger 38 can be engaged with the second bracket 28. The channel 40 can be, for example, triangular in shape so that when installed, the first bracket 26 is secured in place to the second bracket 28. The channel 40 includes symmetrical teeth 42 that are configured to lock in in place when installed to the second bracket 28. As a result, the first bracket 26 can be moved relative to the second bracket 28 when installing the ventilation fan assembly 10 and the first bracket 26 automatically engages with the second bracket 28 to prevent the ventilation fan assembly 10 from falling. The fingers 36, 38 are flexible to accommodate this engagement. In some embodiments, the flexibility of the fingers 36, 38 can also make the first bracket 26 removable from the second bracket 28 to, for example, uninstall the ventilation fan assembly 10 from the ceiling.

Figure 4:
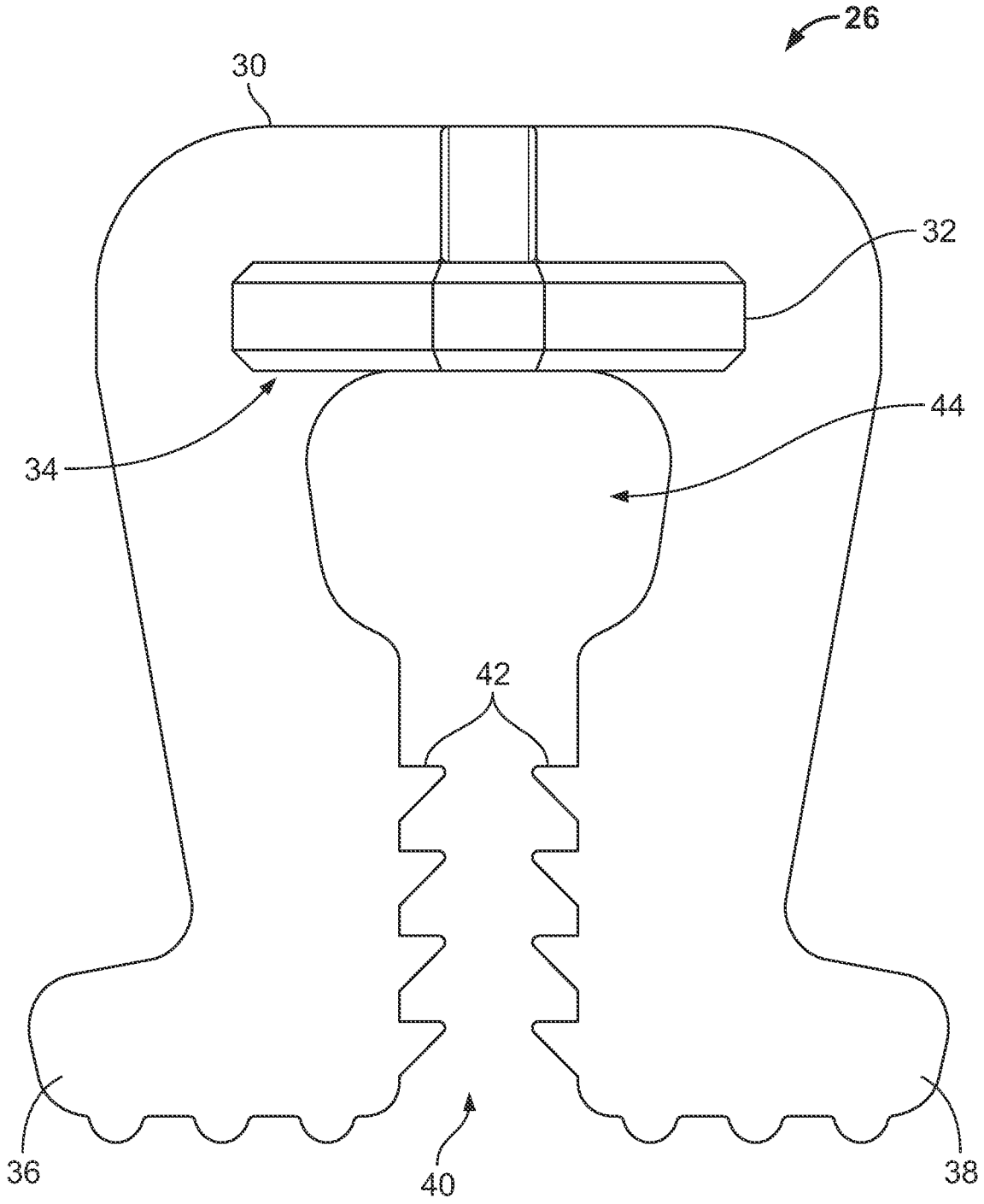
FIG. 4 shows a side view of the first bracket of FIG. 2, according to some embodiments.

FIG. 4 shows a side view of the first bracket 26 of FIG. 2, according to some embodiments. In the illustrated embodiment, the first bracket 26 includes four symmetrical teeth 42. It is to be appreciated that the number of symmetrical teeth 42 can vary beyond four. For example, In some embodiments, there can be less than four symmetrical teeth 42 or more than four symmetrical teeth 42. The number of symmetrical teeth 42 selected can be designed to control an amount of variation in the distance L1 (shown in FIG. 1). A central region 44 between the fingers 36, 38 enables the fingers 36, 38 to flex when connecting the first bracket 26 to the second bracket 28.

Figure 5:
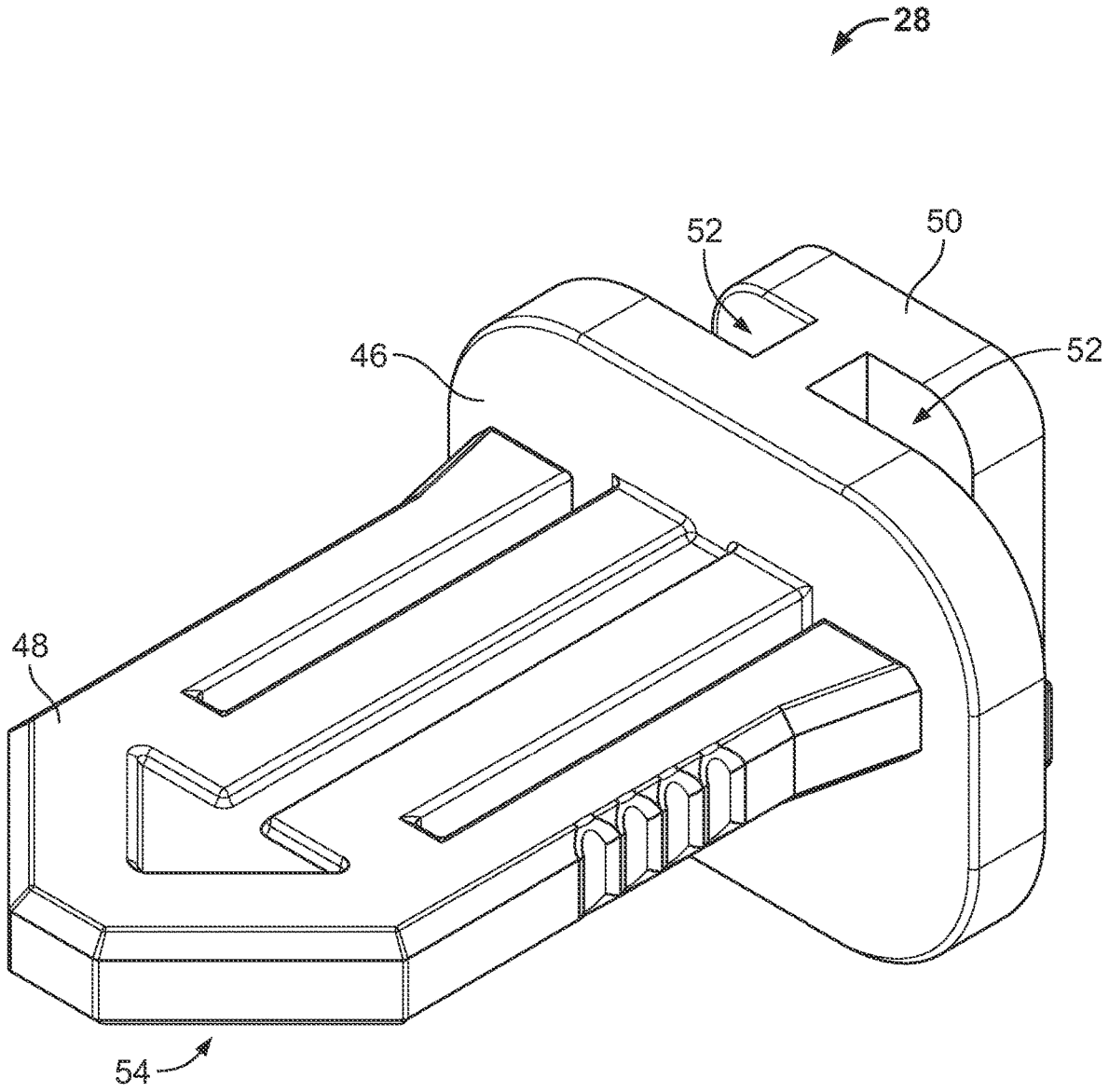
FIG. 5 shows a perspective view of the second bracket of FIG. 2, according to some embodiments.

FIG. 5 shows a perspective view of the second bracket 28 of FIG. 2, according to some embodiments.

The second bracket 28 includes a member 46 having a flange 48 extending therefrom. The member 46 and the flange 48 can be a single piece, unitary construction. As used herein, a single piece, unitary construction means that the member 46 and the flange 48 are integrally formed together, not separate pieces joined together. As such, there are no mechanical fasteners, adhesives, combinations thereof, or the like, between the member 46 and the flange 48. In some embodiments, the single piece can include multiple materials integrally formed. A member 50 protrudes from the member 46 in the direction opposite the flange 48. The member 50 is spaced from the member 46, creating a plurality of channels 52 between the member 46 and the member 50. The flange 48 includes an engagement surface 54 configured to engage the ceiling panel 22 in the installed configuration. The engagement surface 54 can be a planar surface.

Figure 6:
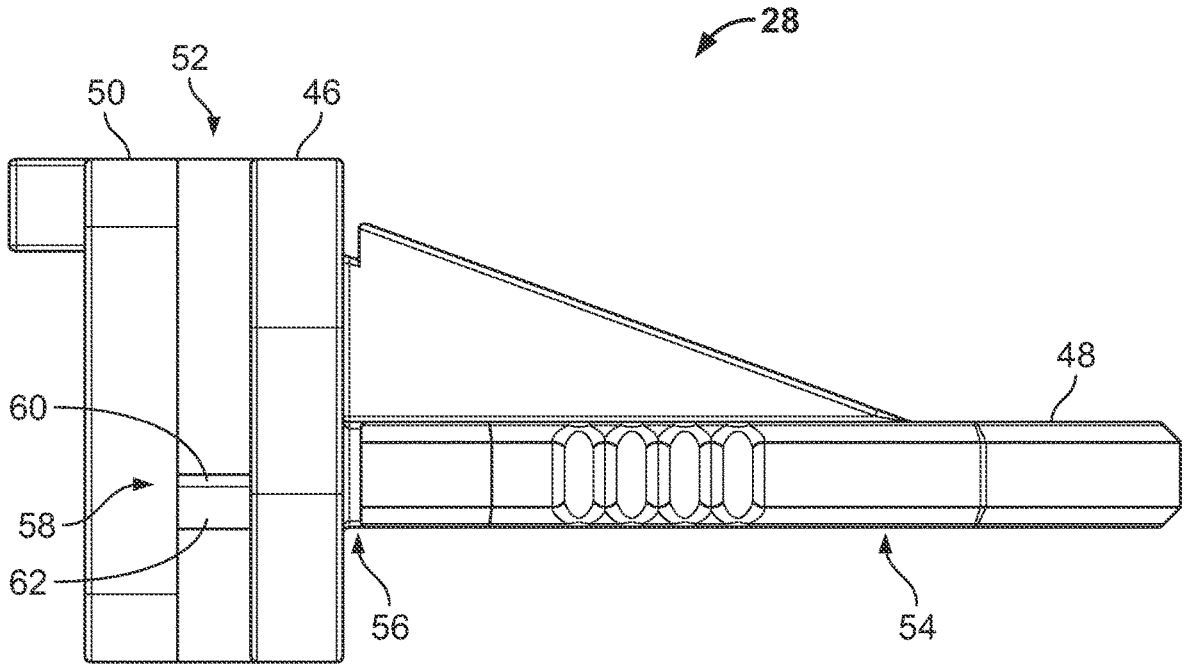
FIG. 6 shows a side view of the second bracket of FIG. 2, according to some embodiments.

FIG. 6 shows a side view of the second bracket 28 of FIG. 2, according to some embodiments.

The flange 48 is spaced from the member 46 by a gap 56. The gap 56 is such that the member 46 is on a first side of the fan housing 12 and the flange 48 is on an opposite side of the fan housing 12 when in the installed configuration. That is, the flange 48 is inserted into an aperture in the fan housing 12 and snap fit into place. The channels 52 include a lock 58. The lock 58 includes an engagement surface 60 that engages with the symmetrical teeth 42 of the first bracket 26. The lock 58 also includes a ramped portion 62 so that the symmetrical teeth 42 can move over the lock 58 and into engagement with the engagement surface 60 when in the installed configuration.

Figure 7:
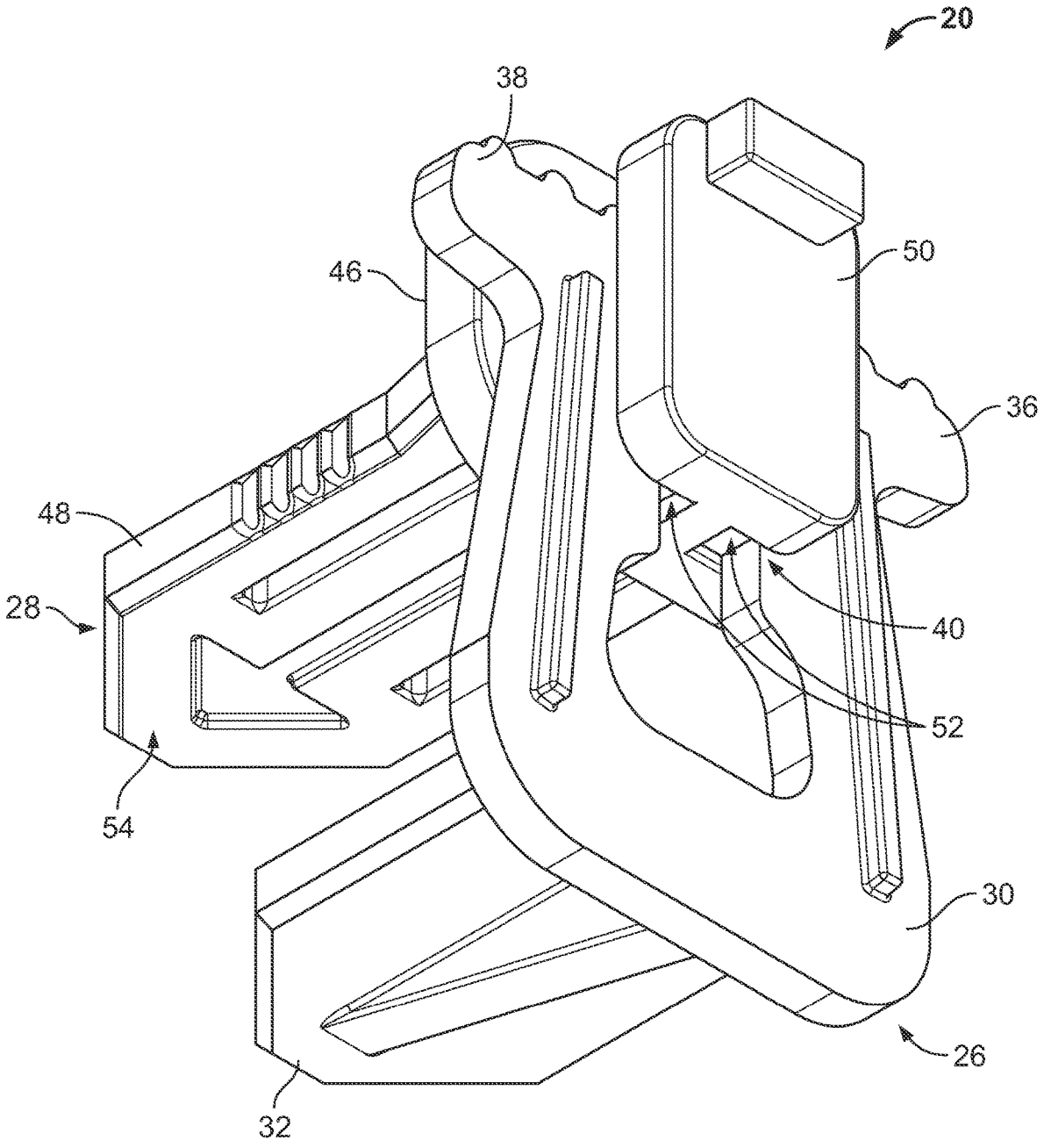
FIG. 7 shows a perspective view of the installation assemblies of FIG. 1, according to some embodiments.
Figure 8:
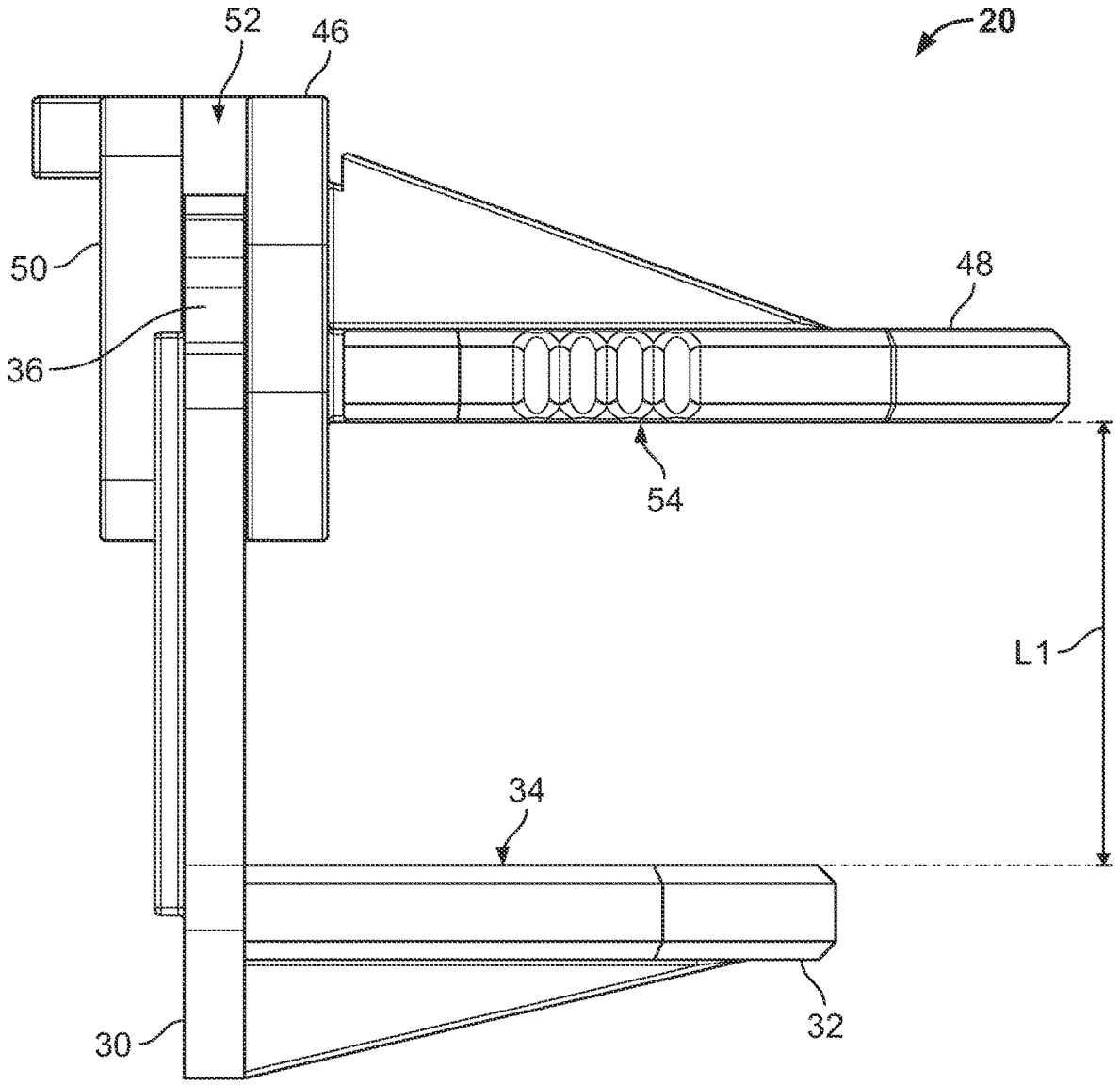
FIG. 8 shows a side view of the installation assemblies of FIG. 1, according to some embodiments.

FIG. 7 shows a perspective view of the installation assemblies 20 of FIG. 1, according to some embodiments. FIG. 8 shows a side view of the installation assemblies 20 of FIG. 1, according to some embodiments. For simplicity of this description, features previously discussed will not be discussed in further detail unless specifically indicated otherwise. In the illustrated embodiment, the fingers 36, 38 are inserted into channels 52. Although not visible in FIGS. 7-8, the first bracket 26 and the second bracket 28 are locked in place relative to each other so that the first bracket 26 cannot be moved away from the second bracket 28 without separating fingers 36, 38. When in the installed configuration, the engagement surface 34 faces the engagement surface 54. In some embodiments, the engagement surface 34 and the engagement surface 54 can be arranged so that their surfaces are parallel in the installed configuration. Additionally, in some embodiments, a surface area of the engagement surface 54 can be greater than a surface area of the engagement surface 34. In some embodiments, this surface area variation can be, for example, a result of the engagement surface 54 primarily supporting a weight of the ventilation fan assembly 10 when in the installed configuration. As illustrated, the distance L1 between the engagement surface 34 and the engagement surface 54 can be varied to sandwich the ceiling panel 22 (not shown in FIGS. 7-8) therebetween.

Figure 9:
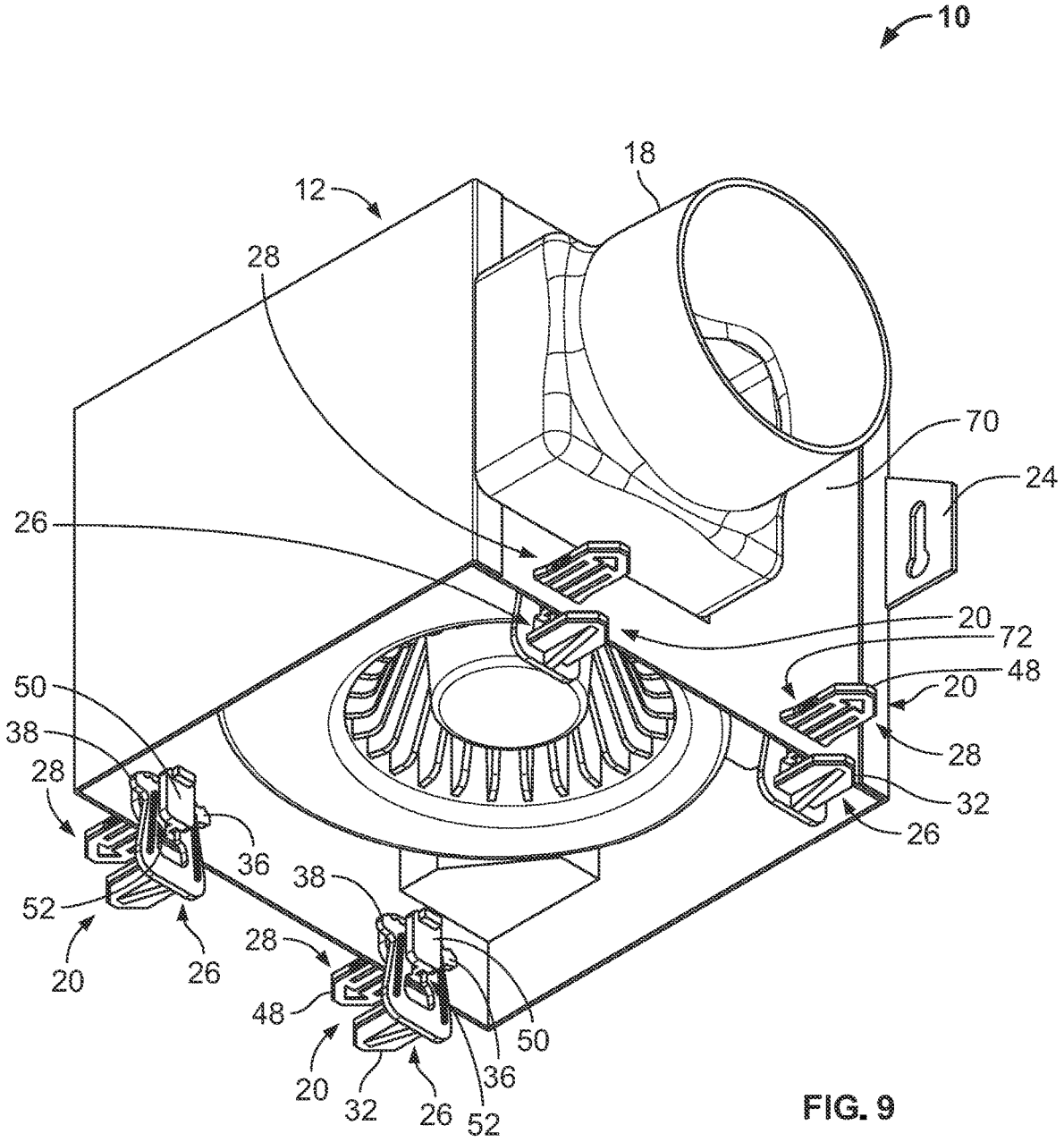
FIG. 9 shows a perspective view of the ventilation fan assembly of FIG. 1, according to some embodiments.

FIG. 9 shows a perspective view of the ventilation fan assembly 10 of FIG. 1, according to some embodiments. In the view of FIG. 9, the fan cover 14 (FIG. 1) and the mounting plate 16 (FIG. 1) of the ventilation fan assembly 10 have been removed for clarity of illustration of other components of the ventilation fan assembly 10. In the view of FIG. 9, the ceiling panel 22 has also been removed for clarity of illustration of other components of the ventilation fan assembly 10.

In the illustrated embodiment, the installation assemblies 20 are shown installed in the fan housing 12 and with the first bracket 26 and the second bracket 28 secured together. In the illustrated embodiment, the ventilation fan assembly 10 includes four installation assemblies 20. It is to be appreciated that this is an example and the number of installation assemblies 20 can vary above or below four.

The first bracket 26 includes a portion that is inside an interior of the fan housing 12 and a portion that is outside the fan housing 12. Similarly, the second bracket 28 includes a portion that is inside the interior of the fan housing 12 and a portion that is outside the fan housing 12. More specifically, the member 50 is disposed on a first side of housing wall 70 (i.e., the interior of fan housing 12) and the flange 48 protrudes from the housing wall 70 via an aperture 72 (i.e., outside the fan housing 12). The member 30 is disposed on a first side of the housing wall 70 (i.e., the interior of fan housing 12) and the flange 32 protrudes beyond the housing wall 70 (i.e., outside the fan housing 12). The flange 32 does not extend through the fan housing 12, but instead extends in a parallel manner to the flange 48 at a location that is outside of the housing wall 70. That is, the housing wall 70 has an extent that is located between the flange 48 and the flange 32 when the installation assemblies 20 are in the installed configuration. The distance between the flange 48 and the flange 32 is adjustable based on a thickness of the ceiling panel 22 (not shown in FIG. 9). In some embodiments, the distance can be limited by the extent of the housing wall 70 such that the flange 32 may be stopped by the housing wall 70.

Additionally, the ceiling panel 22 (not shown in FIG. 9) may have a varying thickness and the installation assemblies 20 can be adjusted to accommodate the various thicknesses so that the flange 48 and the flange 32 of different installation assemblies 20 can be disposed different distances from each other.

Figure 10:
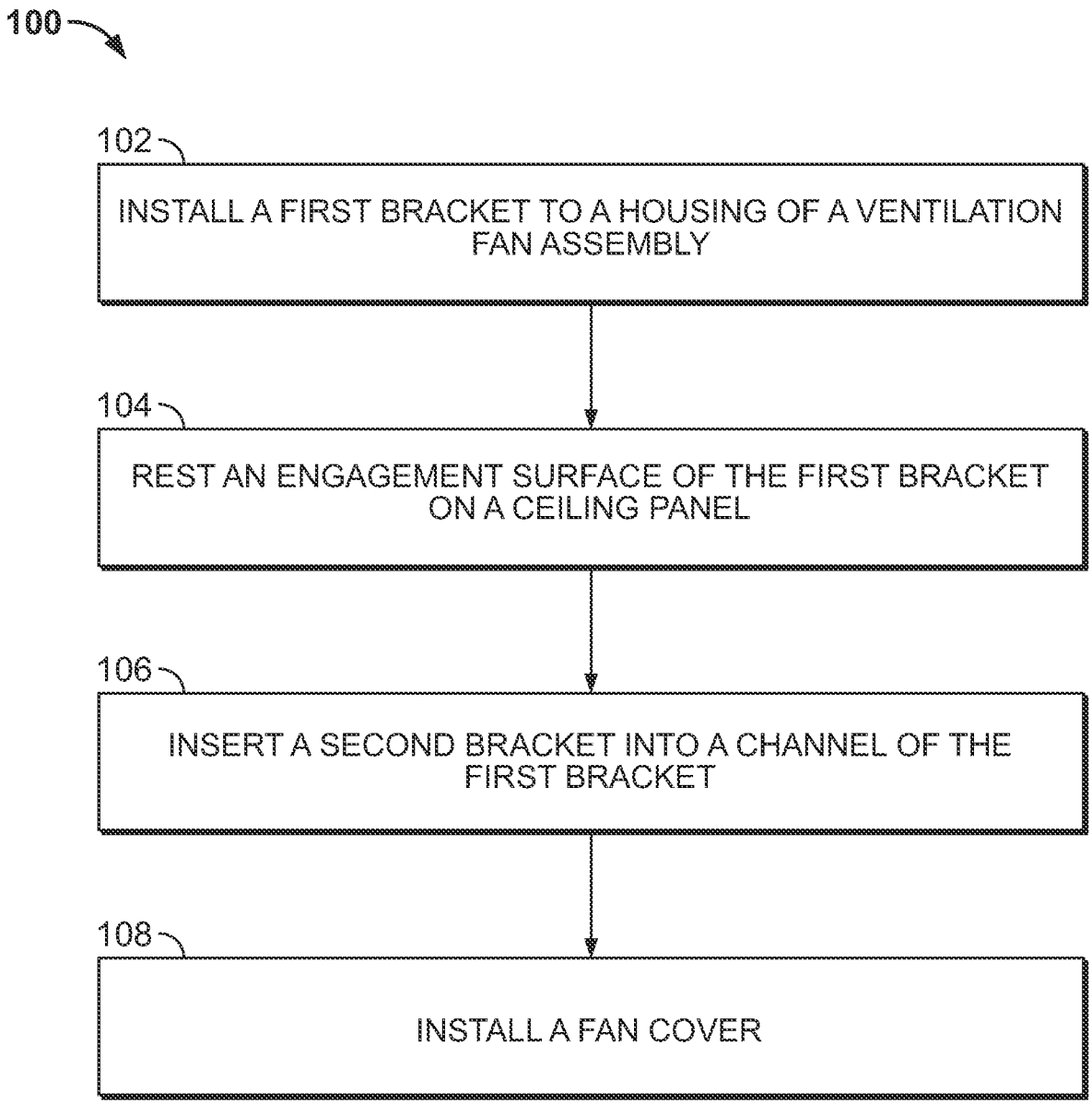
FIG. 10 is a flowchart of a method for installing a ventilation fan assembly such as the ventilation fan assembly of FIG. 1, according to some embodiments.

FIG. 10 is a flowchart of an example method 100 for installing a ventilation fan assembly such as the ventilation fan assembly 10 (FIG. 1), according to some embodiments.

The method 100 includes, at block 102, installing a bracket (e.g., second bracket 28) into an aperture in a housing (e.g., fan housing 12) of a ventilation fan assembly. Block 102 can include installing all brackets into the housing.

At block 104, the method 100 may include resting an engagement surface (e.g., engagement surface 54) of the bracket on an upper surface of a ceiling panel (e.g., ceiling panel 22).

At block 106, the method 100 may include inserting a bracket (e.g., first bracket 26) into a channel (e.g., channels 52). The member is inserted until an engagement surface (e.g., engagement surface 34) engages with a lower surface (e.g., as visible in the installation location) of the ceiling panel. Block 106 can include installing all brackets into the corresponding channels.

At block 108, the method 100 may include installing a fan cover (e.g., fan cover 14) over the ventilation fan assembly.

The terminology used herein is intended to describe embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

It is to be understood that changes may be made in detail, especially in matters of the construction materials employed and the shape, size, and arrangement of parts without departing from the scope of the present disclosure. This Specification and the embodiments described are examples, with the true scope and spirit of the disclosure being indicated by the claims that follow.

What is claimed is:

1. An assembly, comprising:
a first bracket, including:
a first member, the first member including a plurality of fingers and a first channel between the plurality of fingers,
wherein the first channel includes a plurality of teeth;
a first flange extending from the first member and including a first engagement surface;
a second bracket, including:
a second member;
a third member spaced from the second member,
wherein a second channel is formed between the second member and the third member;
a second flange extending from the second member in on an opposite side of the second member from the third member,
wherein the second flange includes a second engagement surface;
wherein in an installed configuration,
the first bracket is secured to the second bracket;
the first engagement surface faces the second engagement surface; and
the plurality of fingers are inserted into the second channel.

2. The assembly of claim 1, wherein the first bracket and the second bracket are different colors.

3. The assembly of claim 1, wherein at least one of the first bracket or the second bracket is made of plastic.

4. The assembly of claim 1, wherein the first member and the first flange are made of a single piece, unitary construction.

5. The assembly of claim 1, wherein the second member and the second flange are made of a single piece, unitary construction.

6. The assembly of claim 1, wherein the second channel includes a lock, and wherein in the installed configuration, the plurality of teeth engage the lock.

7. The assembly of claim 1, wherein the plurality of teeth are symmetrical and disposed on opposite sides of the first channel.

8. A ventilation fan assembly, comprising:
a housing,
wherein the housing includes a plurality of apertures;
an installation assembly, comprising:
a first bracket, including:
a first member, the first member including a plurality of fingers and a first channel between the plurality of fingers, wherein the first channel includes a plurality of teeth;

a first flange extending from the first member and including a first engagement surface;

a second bracket, including:

a second member;

a third member spaced from the second member, wherein a second channel is formed between the second member and the third member;

a second flange extending from the second member in on an opposite side of the second member from the third member, wherein the second flange includes a second engagement surface;

wherein in an installed configuration, the second bracket is inserted through a first of the plurality of apertures;

the first bracket is secured to the second bracket;

the first engagement surface faces the second engagement surface; and the plurality of fingers are inserted into the second channel.

9. The ventilation fan assembly of claim 8, wherein the second bracket is secured to the housing in the installed configuration.

10. The ventilation fan assembly of claim 9, wherein the first bracket is slidably engaged with the second bracket in the installed configuration.

11. The ventilation fan assembly of claim 9, wherein the second bracket is secured to the housing by a snap-fit connection.

12. The ventilation fan assembly of claim 8, further comprising a plurality of installation assemblies.

13. The ventilation fan assembly of claim 12, wherein the plurality of installation assemblies includes four installation assemblies.

14. The ventilation fan assembly of claim 8, further comprising a fan cover.

15. The ventilation fan assembly of claim 8, wherein the first member and the first flange are made of a single piece, unitary construction.

16. The ventilation fan assembly of claim 8, wherein the second member and the second flange are made of a single piece, unitary construction.

17. The ventilation fan assembly of claim 8, wherein the second channel includes a lock, and wherein in the installed configuration, the plurality of teeth engage the lock.

18. The ventilation fan assembly of claim 8, wherein the plurality of teeth are symmetrical and disposed on opposite sides of the first channel.

19. A method, comprising:

installing a first bracket into an aperture in a housing of a ventilation fan assembly;

resting an engagement surface of a flange of the first bracket on an upper surface of a ceiling panel; and inserting a second bracket into a channel of the first bracket until an engagement surface of the second bracket engages with a lower surface of the ceiling panel, wherein the lower surface is opposite the upper surface.

20. The method of claim 19, further comprising installing a fan cover to the housing.

* * * * *